US009909226B2

(12) United States Patent
Hiraoka et al.

(10) Patent No.: US 9,909,226 B2
(45) Date of Patent: Mar. 6, 2018

(54) FILM FORMATION SYSTEM AND FILM FORMATION METHOD FOR FORMING METAL FILM

(71) Applicant: TOYOTA JIDOSHA KABUSHIKI KAISHA, Toyota-shi, Aichi-ken (JP)

(72) Inventors: Motoki Hiraoka, Toyota (JP); Hiroshi Yanagimoto, Miyoshi (JP); Yuki Sato, Nagakute (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 14/912,234

(22) PCT Filed: Aug. 20, 2014

(86) PCT No.: PCT/IB2014/001567

§ 371 (c)(1),
(2) Date: Feb. 16, 2016

(87) PCT Pub. No.: WO2015/025211

PCT Pub. Date: Feb. 26, 2015

(65) Prior Publication Data

US 2016/0201210 A1 Jul. 14, 2016

(30) Foreign Application Priority Data

Aug. 20, 2013 (JP) ..... 2013-170336

(51) Int. Cl.

| | |
|---|---|
| ***C25D 17/14*** | (2006.01) |
| ***C25D 5/04*** | (2006.01) |
| ***C25D 5/06*** | (2006.01) |
| ***C25D 5/22*** | (2006.01) |
| ***C25D 17/00*** | (2006.01) |
| ***C25D 5/08*** | (2006.01) |
| ***C25D 17/12*** | (2006.01) |
| ***C25D 21/04*** | (2006.01) |

(52) U.S. Cl.
CPC ..... *C25D 5/04* (2013.01); *C25D 5/08* (2013.01); *C25D 5/22* (2013.01); *C25D 17/00* (2013.01);
(Continued)

(58) Field of Classification Search
CPC ..... C25D 17/14
See application file for complete search history.

(56) References Cited

U.S. PATENT DOCUMENTS 5,453,174 A * 9/1995 Van Anglen ..... C25D 5/06 204/212
2009/0242410 A1* 10/2009 Castro ..... C25D 3/12 205/118

(Continued)

FOREIGN PATENT DOCUMENTS

JP 55-138892 A 10/1980
JP 01165786 A 6/1989

(Continued)

OTHER PUBLICATIONS

Database WPI Week, 198932 Thomson Scientific, London, GB, Jun. 29, 1989, AN 1989-231016, 2 pages.

(Continued)

*Primary Examiner* — Bryan D. Ripa
(74) *Attorney, Agent, or Firm* — Sughrue Mion, PLLC

(57) ABSTRACT

A solid electrolyte membrane (13) is arranged on a surface of an anode (11) between the anode (11) and a substrate (B) that serves as a cathode. The solid electrolyte membrane (13) is brought into contact with the substrate (B). At the same time, a metal film (F) is formed on the surface of the substrate (B) by causing metal to precipitate onto the surface of the substrate (B) from metal ions through application of voltage between the anode (11) and the substrate (B) in a first contact state where the solid electrolyte membrane (13) contacts the substrate (B). The metal ions are contained inside the solid electrolyte membrane (13).

6 Claims, 3 Drawing Sheets

(52) U.S. Cl.
CPC ..... *C25D 17/002* (2013.01); *C25D 17/007* (2013.01); *C25D 17/12* (2013.01); *C25D 17/14* (2013.01); *C25D 21/04* (2013.01)

(56) References Cited

U.S. PATENT DOCUMENTS

| | | | | |
|---|---|---|---|---|
| 2014/0224662 | A1* | 8/2014 | Arumugam | C25D 5/06 205/93 |
| 2015/0014178 | A1 | 1/2015 | Hiraoka et al. | |
| 2016/0108534 | A1* | 4/2016 | Dai | C25D 5/02 205/117 |
| 2016/0177463 | A1* | 6/2016 | Arumugam | C25D 5/22 205/93 |

FOREIGN PATENT DOCUMENTS

| | | | | | |
|---|---|---|---|---|---|
| JP | 05148681 | A | * | 6/1993 | C25D 5/04 |
| JP | 2005-042158 | A | | 2/2005 | |
| JP | 2005133187 | A | | 5/2005 | |
| JP | 2010-037622 | A | | 2/2010 | |
| JP | 2012-219362 | A | | 11/2012 | |
| WO | 2007/106911 | A2 | | 9/2007 | |
| WO | 2013/125643 | A1 | | 8/2013 | |

OTHER PUBLICATIONS

Kensuke Akamatsu et al.: "Fabrication of Silver Patterns on Polyimide Films Based on Solid-Phase Electrochemical Constructive Lithography Using Ion-Exchangeable Precursor Layers", Langmuir 2011, 27 (19), pp. 11761-11766.

* cited by examiner

FILM FORMATION SYSTEM AND FILM FORMATION METHOD FOR FORMING METAL FILM

BACKGROUND OF THE INVENTION

1. Field of the Invention

The invention relates to a film formation system and film formation method for forming a metal film and, more particularly, to a film formation system and film formation method that are able to form a thin metal film uniformly on a surface of a substrate.

2. Description of Related Art

Generally, when an electronic circuit substrate, or the like, is manufactured, a metal film is formed on the surface of a substrate in order to form a metal circuit pattern. For example, as a film formation technique for forming such a metal film, there has been suggested a film formation technique for forming a metal film on the surface of a semiconductor substrate, such as Si, by plating, such as electroless plating (see, for example, Japanese Patent Application Publication No. 2010-037622 (JP 2010-037622 A)) or forming a metal film by a PVD method, such as sputtering.

However, when the plating, such as electroless plating, is performed, the plated substrate needs to be washed in water, so it is required to treat waste liquid used in water washing. When a film is formed on the surface of the substrate by the PVD method, such as sputtering, internal stress develops in the coated metal film, so there is a limit to increase the thickness of the film, and, particularly, in the case of sputtering, there are cases where the film is allowed to be formed only in a high vacuum.

In terms of such a point, for example, a film formation method for forming a metal film has been suggested (see, for example, Japanese Patent Application Publication No. 2012-219362 (JP 2012-219362 A)). The film formation method uses an anode, a cathode, a solid electrolyte membrane and a power supply unit. The solid electrolyte membrane is arranged between the anode and the cathode. The power supply unit applies voltage between the anode and the cathode.

The solid electrolyte membrane is formed by spin-coating a solution containing a precursor of the solid electrolyte membrane on the surface of a substrate and curing the solution in advance. Metal ions to be coated are impregnated in the solid electrolyte membrane. The substrate is arranged opposite the anode so as to be electrically conductive with the cathode. The metal ions impregnated inside the solid electrolyte membrane are precipitated at a cathode side by applying voltage between the anode and the cathode. Thus, it is possible to form a metal film made of a metal of the metal ions.

However, when the technique described in JP 2012-219362 A is used, a film is formed while bringing the solid electrolyte membrane into contact with the substrate without any gap, so gas (hydrogen gas) is produced as a by-product between the solid electrolyte membrane and the substrate (metal film), and the gas remains in the metal film in a compressed state in process of film formation. The remaining gas becomes a factor developing a defect, such as a void and a pinhole, in the metal film.

SUMMARY OF THE INVENTION

The invention provides a film formation system and film formation method for forming a metal film, which are able to form a metal film difficult to develop a defect, such as a void and a pinhole.

A first aspect of the invention provides a film formation method for forming a metal film. The film formation method includes: arranging a solid electrolyte membrane on a surface of an anode between the anode and a substrate, the substrate serving as a cathode; bringing the solid electrolyte membrane into contact with the substrate; forming a metal film on a surface of the substrate by causing metal to precipitate onto the surface of the substrate from metal ions through application of voltage between the anode and the substrate in a first contact state where the solid electrolyte membrane contacts the substrate, the metal ions being contained inside the solid electrolyte membrane, the metal film being made of the metal; during formation of the metal film, suspending formation of the metal film by changing a relative position between the solid electrolyte membrane and the substrate from the first contact state to a non-contact state where the solid electrolyte membrane does not contact the substrate; after suspension of the formation, changing the relative position between the solid electrolyte membrane and the substrate into a second contact state different from the first contact state; and resuming formation of the metal film in the second contact state.

According to the first aspect, the solid electrolyte membrane is arranged on the surface of the anode, and the solid electrolyte membrane is brought into contact with the substrate. In this first contact state, the metal film is formed on the surface of the substrate by causing the metal to precipitate onto the surface of the substrate from the metal ions contained inside the solid electrolyte membrane through application of voltage between the anode and the substrate.

At this time, during formation of the metal film, formation of the metal film is suspended by changing the relative position between the solid electrolyte membrane and the substrate from the first contact state to the non-contact state, so it is possible to deaerate (degas) gas (gas in a pressurized state), produced as a by-product during film formation, from the formed metal film.

Subsequently, after suspension of the formation, the relative position between the solid electrolyte membrane and the substrate into the second contact state different from the first contact state, and formation of the metal film is resumed in the second contact state. In this way, by changing the relative position between the solid electrolyte membrane and the substrate into the different contact state, gas, that is, a by-product, is difficult to be produced at the same portion after film formation is resumed. In this way, film formation is resumed by changing the relative position between the solid electrolyte membrane and the substrate, so it is possible to suppress development of a defect, such as a pinhole.

As long as the solid electrolyte membrane contacts the film formation region in which the metal film is formed on the substrate and the metal film is allowed to be formed in a desired range of the film formation region, the solid electrolyte membrane and the substrate may be relatively moved linearly in changing the relative position between the solid electrolyte membrane and the substrate.

In the above first aspect, at the time of resuming formation of the metal film, the relative position between the solid electrolyte membrane and the substrate may be changed by relatively rotationally moving the solid electrolyte membrane and the substrate.

According to this aspect, it is possible to change the relative position between the solid electrolyte membrane and the substrate by relatively rotationally moving the solid electrolyte membrane and the substrate, and further form a metal film on the metal film already formed on the surface of the substrate so as to completely coincide with the already formed metal film. For example, when the film formation region has a circular shape, the solid electrolyte membrane and the substrate may be relatively rotationally moved around the rotation center set to the center of the circular film formation region. When the film formation region has a square shape, the solid electrolyte membrane and the substrate just need to be rotated by 90°, 180° or 270° around a rotation axis set to the center of the square film formation region. When the film formation region has a rectangular shape, the solid electrolyte membrane and the substrate just need to be rotated by 180° around a rotation axis set to the center of the rectangular film formation region.

The solid electrolyte membrane may be impregnated with a solution containing metal ions each time the metal film is formed. In this case, a non-porous material may be used as the anode. However, in the above first aspect, a porous material may be used as the anode, and the porous material may allow a solution containing the metal ions to penetrate through the porous material and supply the metal ions to the solid electrolyte membrane.

According to this aspect, by using the anode made of the porous material, it is possible to cause the solution containing the metal ions to penetrate through the inside of the anode, so it is possible to supply the penetrated solution to the solid electrolyte membrane. Thus, during film formation, it is possible to supply the solution containing the metal ions at any time via the anode made of the porous material. The supplied solution containing the metal ions penetrates through the inside of the anode and contacts the solid electrolyte membrane adjacent to the anode, and the metal ions are impregnated into the solid electrolyte membrane.

It is possible to pressurize the solid electrolyte membrane with the anode. Thus, during film formation, it is possible to supply the metal ions from the anode to the solid electrolyte membrane, and form a film while pressurizing the substrate with the solid electrolyte membrane.

As a result, the metal ions in the solid electrolyte membrane precipitate during film formation, and are supplied from the anode side. Thus, there is no limit to the amount of metal that is allowed to be precipitated, so it is possible to successively form the metal film having a desired thickness on the surfaces of a plurality of substrates.

When the porous material is used as the anode and the substrate is pressurized by the anode via the solid electrolyte membrane, because the anode has a porous surface, there arise variations in pressure that acts on the surface of the substrate, and a defect, such as a pinhole, is easy to develop in the metal film to be formed because of the variations. However, as described above, even in the above aspect, because the relative position between the solid electrolyte membrane and the substrate is changed and then film formation of the metal film is resumed, the state of variations in pressure at the interface therebetween also changes. Thus, not only the thickness of the metal film becomes uniform, but also poor contact between the solid electrolyte membrane and the substrate is alleviated and development of a defect, such as a pinhole, is also suppressed.

In the above aspect, the film formation method may further include, in forming the metal film, uniformly pressurizing a film formation region of the substrate with the solid electrolyte membrane by pressurizing a surface of the anode. The surface of the anode may correspond to the film formation region in which the metal film is formed within the surface of the substrate.

As a result, in forming the metal film, it is possible to pressurize the surface of the anode corresponding to the film formation region in which the metal film is formed (that is, the surface of the anode, which coincides with the film formation region) within the surface of the substrate. Thus, it is possible to uniformly pressurize the film formation region of the substrate with the solid electrolyte membrane, so it is possible to form the metal film on the substrate in a state where the solid electrolyte membrane is caused to uniformly follow the film formation region of the substrate. As a result, it is possible to form the homogeneous metal film having a uniform thickness with less variations on the surface that corresponds to the film formation region of the substrate.

When the film formation region of the substrate is uniformly pressurized by the solid electrolyte membrane, gas, that is, a by-product, is easy to accumulate in a compressed state during film formation. As described above, in this aspect as well, the relative position between the solid electrolyte membrane and the substrate is changed from the first contact state to the non-contact state in process of film formation, so it is possible to deaerate gas, that is, a by-product, from the surface of the metal film.

A second aspect of the invention provides a film formation system for forming a metal film. The film formation system includes an anode, a solid electrolyte membrane, a power supply unit and a change mechanism. The solid electrolyte membrane is arranged on a surface of the anode between the anode and a substrate. The substrate serves as a cathode. The power supply unit is configured to apply voltage between the anode and the substrate. The power supply unit is configured to apply voltage between the anode and the substrate. The film formation system is configured to form a metal film on a surface of the substrate by causing metal to precipitate onto the surface of the substrate from metal ions through application of voltage between the anode and the substrate in a first contact state where the solid electrolyte membrane contacts the substrate. The metal ions are contained inside the solid electrolyte membrane. The metal film is made of the metal. The change mechanism is configured to change a relative position between the solid electrolyte membrane and the substrate from the first contact state to a non-contact state where the solid electrolyte membrane does not contact the substrate and then change the relative position into a second contact state different from the first contact state.

According to the second aspect, during film formation, in a state where the solid electrolyte membrane is arranged on the anode, the solid electrolyte membrane is brought into contact with the substrate. In this state, by applying voltage with the power supply unit between the anode and the substrate serving as the cathode, it is possible to cause metal to precipitate onto the surface of the substrate from the metal ions contained inside the solid electrolyte membrane. As a result, it is possible to form the metal film made of metal of the metal ions on the surface of the substrate.

At this time, during formation of the metal film, formation of the metal film is suspended by changing the relative position between the solid electrolyte membrane and the substrate from the first contact state to the non-contact state, and, after suspension of the formation, the relative position between the solid electrolyte membrane and the substrate is changed into the second contact state different from the first contact state by using the change mechanism, so it is possible to resume formation of the metal film in the second contact state.

As a result, as described above, it is possible to deaerate (degas) gas (gas in a pressurized state), produced as a by-product during film formation, from the formed metal film, and gas, that is, a by-product, is difficult to be produced at the same portion after film formation is resumed.

As long as the solid electrolyte membrane contacts the film formation region in which the metal film is formed on the substrate and the metal film is allowed to be formed in a desired range of the film formation region, the mechanism that changes the relative position between the solid electrolyte membrane and the substrate is not limited. For example, the mechanism may be a mechanism that changes the relative position between the solid electrolyte membrane and the substrate by relatively linearly moving the solid electrolyte membrane and the substrate.

In the second aspect, the change mechanism may be configured to change the relative position between the solid electrolyte membrane and the substrate by relatively rotationally moving the solid electrolyte membrane and the substrate.

According to this aspect, it is possible to change the relative position between the solid electrolyte membrane and the substrate by relatively rotationally moving the solid electrolyte membrane and the substrate, and further form a metal film on the metal film already formed on the surface of the substrate so as to completely coincide with the already formed metal film.

In the second aspect, the anode may be made of a porous material. The porous material may allow a solution containing the metal ions to penetrate through the porous material and supply the metal ions to the solid electrolyte membrane. According to this aspect, the anode made of the porous material is able to cause the solution containing the metal ions to penetrate through the inside of the anode, and is able to supply (the metal ions in) the penetrated solution to the solid electrolyte membrane. Thus, during film formation, it is possible to supply the solution containing the metal ions at any time via the anode made of the porous material. The supplied solution containing the metal ions penetrates through the inside of the anode and contacts the solid electrolyte membrane adjacent to the anode, and the metal ions are impregnated into the solid electrolyte membrane.

As a result, the metal ions in the solid electrolyte membrane precipitate during film formation, and are supplied from the anode side. Thus, there is no limit to the amount of metal that is allowed to be precipitated, so it is possible to successively form the metal film having a desired thickness on the surfaces of a plurality of substrates.

As described above, when the anode made of the porous material is used, it is easy to cause variations in contact pressure between the solid electrolyte membrane and the substrate; however, the relative position between the solid electrolyte membrane and the substrate is changed and then formation of the metal film is resumed, so the state of variations in pressure at the interface therebetween also changes. Thus, not only the thickness of the metal film becomes uniform, but also development of a defect, such as a pinhole, is also suppressed.

In the above aspect, the film formation system may further include a contact pressurizing unit configured to contact the anode and pressurize the surface of the substrate with the solid electrolyte membrane via the anode. The contact pressurizing unit may be configured to pressurize a surface of the anode so as to uniformly pressurize a film formation region. The surface of the anode may correspond to the film formation region in which the metal film is formed within the surface of the substrate.

According to this aspect, in forming the metal film, it is possible to pressurize the surface of the anode corresponding to the film formation region in which the metal film is formed (that is, the surface of the anode, which coincides with the film formation region) within the surface of the substrate by the contact pressurizing unit. Thus, it is possible to uniformly pressurize the film formation region of the substrate with the solid electrolyte membrane, so it is possible to form the metal film on the substrate in a state where the solid electrolyte membrane is caused to uniformly follow the film formation region of the substrate. As a result, it is possible to form the homogeneous metal film having a uniform thickness with less variations on the surface that corresponds to the film formation region of the substrate.

According to the aspects of the invention, it is possible to form the metal film in which a defect, such as a void and a pinhole, is hard to develop.

BRIEF DESCRIPTION OF THE DRAWINGS

Features, advantages, and technical and industrial significance of exemplary embodiments of the invention will be described below with reference to the accompanying drawings, in which like numerals denote like elements, and wherein:

FIG. 3A to FIG. 3D are schematic cross-sectional views for illustrating a method of forming a metal film by using the film formation system shown in FIG. 2, in which FIG. 3A is a view for illustrating formation of a metal film, FIG. 3B is a view that shows a state in changing a relative position between a substrate and a film formation system, shown in FIG. 3A, from a contact state to a non-contact state, FIG. 3C is a view that shows a state where the substrate and the solid electrolyte membrane are relatively rotationally moved in order to change the relative position, and FIG. 3D is a view for illustrating formation of a metal film in a contact state different from the contact state shown in FIG. 3A.

DETAILED DESCRIPTION OF EMBODIMENTS

Hereinafter, a film formation system that is able to suitably carry out a film formation method for forming a metal film according to an embodiment of the invention will be described.

Figure 1:
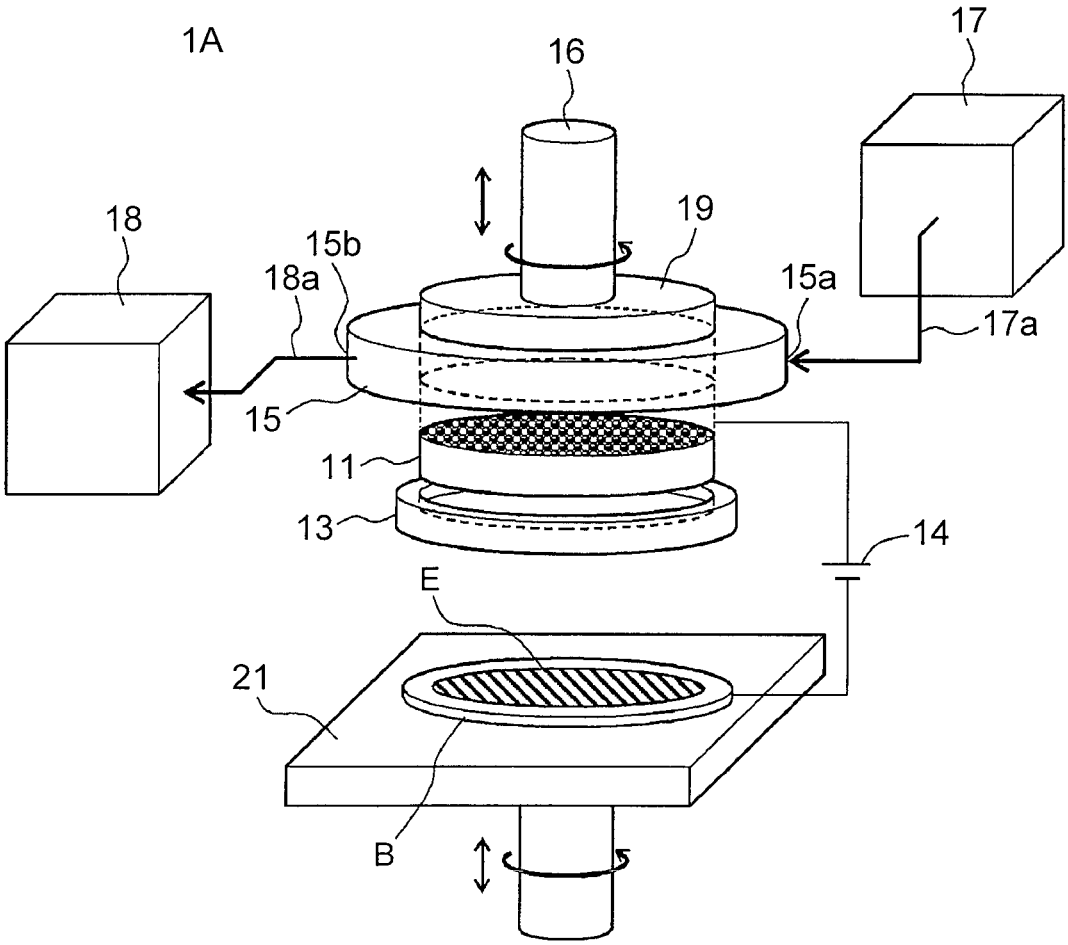
FIG. 1 is a schematic conceptual view of a film formation system for forming a metal film according to a first embodiment of the invention.
Figure 2:
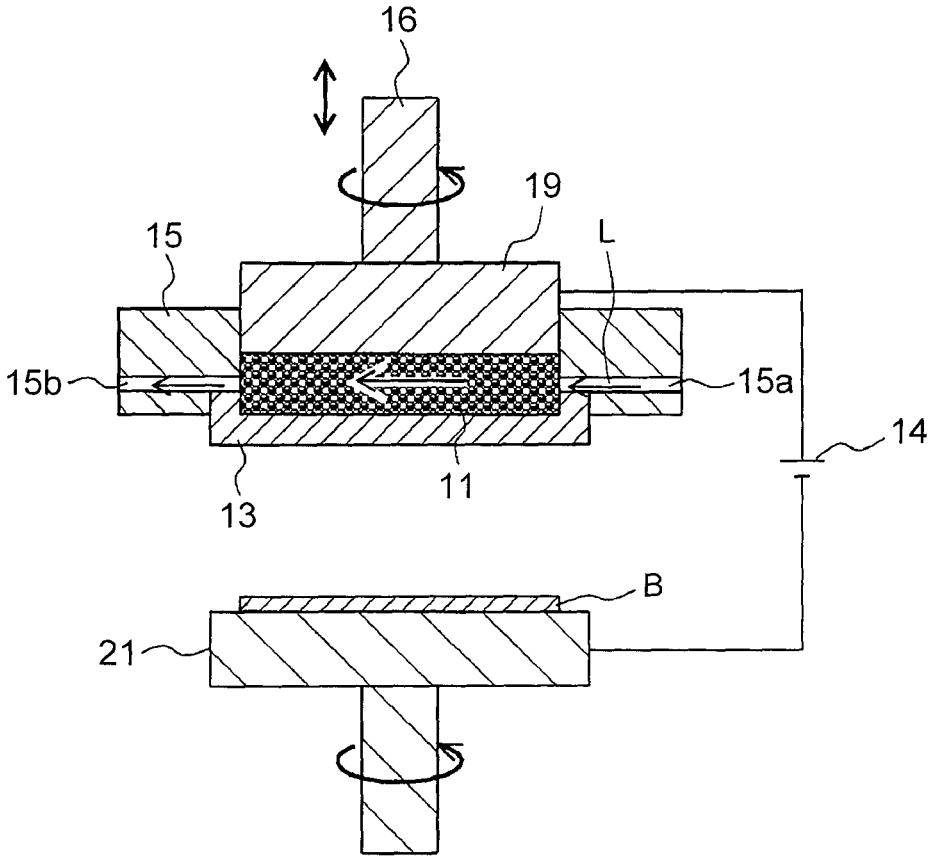
FIG. 2 is a schematic cross-sectional view for illustrating a film formation method that is employed in the film formation system for forming a metal film, shown in FIG. 1.

FIG. 1 is a schematic conceptual view of the film formation system for forming a metal film according to the first embodiment of the invention. FIG. 2 is a schematic cross-sectional view for illustrating the film formation method that is employed in the film formation system for forming a metal film, shown in FIG. 1.

As shown in FIG. 1, the film formation system 1A according to the invention causes metal to precipitate from metal ions and forms a metal film made of the precipitated metal onto the surface of a substrate B. A substrate made of a metal material, such as aluminum, or a substrate in which a metal base layer is formed on the treated surface of a resin or silicon substrate is used as the substrate B.

The film formation system 1A at least includes a metallic anode 11, a solid electrolyte membrane 13 and a power supply unit 14. The solid electrolyte membrane 13 is arranged on the surface of the anode 11 between the anode 11 and the substrate B that serves as a cathode.

The anode 11 is accommodated in a housing (metal ion supply unit) 15 that supplies the anode 11 with a solution L containing metal ions (hereinafter, referred to as metal ion solution). The housing 15 has a through-hole portion extending through in the vertical direction, and the anode 11 is accommodated in the internal space of the housing 15. The solid electrolyte membrane 13 has a recessed portion so as to cover the lower face of the anode 11. The solid electrolyte membrane 13 covers the lower-side opening of the through-hole portion of the housing 15 in a state where the lower portion of the anode 11 is accommodated in solid electrolyte membrane 13.

In the through-hole portion of the housing 15, a contact pressurizing unit (metal punch) 19 is arranged in contact with the upper face of the anode 11, and is used for pressurizing the anode 11. The contact pressurizing unit 19 pressurizes the surface of the substrate B with the solid electrolyte membrane 13 via the anode 11. Specifically, the contact pressurizing unit 19 pressurizes the surface of the anode 11 so as to uniformly pressurize a film formation region E within the surface of the substrate B. The metal film F is formed in the film formation region E. The surface of the anode 11 corresponds to the film formation region E In the present embodiment, the lower face of the anode 11 has an area that coincides with the film formation region E of the substrate B, and the upper face and lower face of the anode 11 have the same area. Thus, when the upper face (entire face) of the anode 11 is pressurized with the contact pressurizing unit 19 by using the thrust of pressurizing means 16 (described later), it is possible to uniformly pressurize the film formation region (entire region) E of the substrate B with the lower face (entire face) of the anode 11 via the solid electrolyte membrane 13.

A solution tank 17 is connected to one side of the housing 15 via a supply tube 17*a*, and a waste solution tank 18 is connected to the other side of the housing 15 via a waste solution tube 18*a*. The metal ion solution L is contained in the solution tank 17. The waste solution tank 18 collects used waste solution.

The supply tube 17*a* is connected to a supply flow passage 15*a* in the housing 15 for supplying the metal ion solution L. The waste solution tube 18*a* is connected to a drain flow passage 15*b* in the housing 15 for draining the metal ion solution L. As shown in FIG. 2, the anode 11 made of a porous material is arranged in a flow passage that connects the supply flow passage 15*a* of the housing 15 to the drain flow passage 15*b* of the housing 15.

With this configuration, the metal ion solution L contained in the solution tank 17 is supplied to the inside of the housing 15 via the supply tube 17*a*. Inside the housing 15, the metal ion solution L passes through the supply flow passage 15*a*, and the metal ion solution L flows from the supply flow passage 15*a* into the anode 11. The metal ion solution L that has passed through the anode 11 flows through the drain flow passage 15*b*, and is transferred to the waste solution tank 18 via the waste solution tube 18*a*.

The pressurizing means 16 is connected to the contact pressurizing unit 19. The pressurizing means 16 moves the anode 11 toward the substrate B, and thus pressurizes the solid electrolyte membrane 13 toward the film formation region E of the substrate B. For example, a hydraulic or pneumatic cylinder, or the like, may be used as the pressurizing means 16. The pressurizing means 16 includes a rotary driving mechanism. The pressurizing means 16 is able to rotate the overall housing 15 including the solid electrolyte membrane 13 by actuating the rotary driving mechanism.

The film formation system 1A includes a base 21. The base 21 fixes the substrate B, and adjusts alignment of the substrate B with respect to the anode 11. The base 21 also includes a rotary driving mechanism. The base 21 is able to rotate the substrate B mounted on the base 21 by actuating the rotary driving mechanism.

The above-described pressurizing means 16 and the rotary driving mechanisms respectively provided in the pressurizing means 16 and the base 21 correspond to a change mechanism. The change mechanism changes a relative position between the solid electrolyte membrane 13 and the substrate B from a contact state (first contact state) where the solid electrolyte membrane 13 contacts the substrate B to a non-contact state, and then changes the relative position into a contact state (second contact state) different from the former contact state. That is, in the present embodiment, it is possible to set the solid electrolyte membrane 13 and the substrate B to any one of the contact state and the non-contact state by using the pressurizing means. By activating the rotary driving mechanisms, the solid electrolyte membrane 13 and the substrate B are relatively rotationally moved. As a result, it is possible to change the relative position where the solid electrolyte membrane 13 contacts the substrate B.

The anode 11 is made of a porous material. The porous material allows the metal ion solution L to penetrate therethrough, and supplies metal ions to the solid electrolyte membrane. Such a porous material is not specifically limited as long as the porous material has the following properties. (1) The porous material has a corrosion resistance against the metal ion solution L. (2) The porous material has such a conductivity that the porous material is able to function as an anode. (3) The porous material allows the metal ion solution L to penetrate therethrough. (4) The porous material is allowed to be pressurized by the pressurizing means 16 via the contact pressurizing unit 19 (described later). The porous material may be, for example, a foamed metal material having a lower ionization tendency (or higher electrode potential) than plating metal ions and made of an open-pore open-cell material. The foamed metal material may be foamed titanium, or the like.

The porous material is not specifically limited as long as the porous material satisfies the above-described condition (3). When a foamed metal material is used, the foamed metal material desirably has a porosity of about 50 to 95 percent by volume, pore sizes of about 50 to 600 μm and a thickness of about 0.1 to 50 mm.

For example, a solution, or the like, containing copper ions, nickel ions or silver ions, may be used as the metal ion solution L. For example, in the case of copper ions, a solution containing copper sulfate, copper pyrophosphate, or the like, may be used. A membrane, a film, or the like, made of a solid electrolyte may be used as the solid electrolyte membrane 13.

The solid electrolyte membrane 13 is not specifically limited as long as the solid electrolyte membrane 13 is allowed to be impregnated with metal ions by bringing the solid electrolyte membrane 13 into contact with the above-described metal ion solution L, and the solid electrolyte membrane 13 is able to cause metal derived from metal ions to precipitate onto the surface of the substrate B through application of voltage. For example, a fluorine-based resin, such as Nafion (trademark; produced by DuPont), a hydrocarbon-based resin, a poliamic acid resin, and a resin having an ion exchange function, such as Selemion (CMV, CMD, CMF series) produced by Asahi Glass, Co., Ltd., may be used as the material of the solid electrolyte membrane.

Figure 3A:
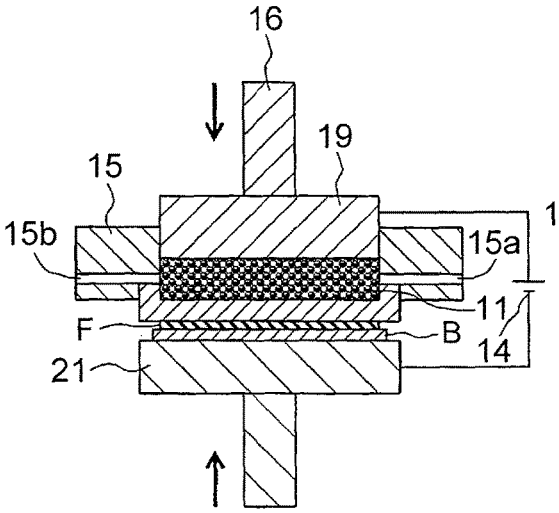
Figure 3B:
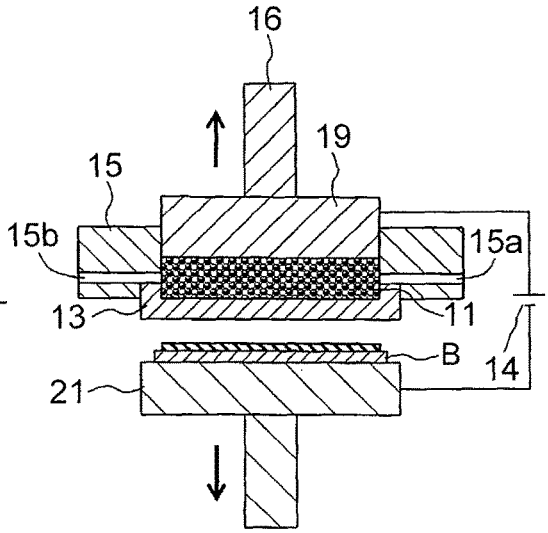
Figure 3C:
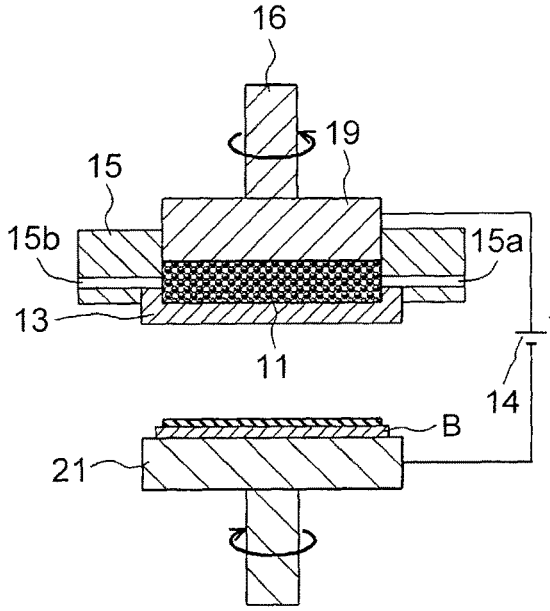
Figure 3D:
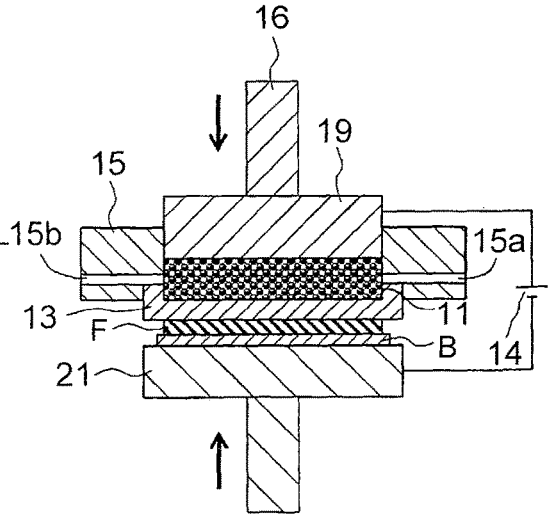

Hereinafter, the film formation method according to the present embodiment will be described. FIG. 3A to FIG. 3D are schematic cross-sectional views for illustrating a method of forming a metal film by using the film formation system shown in FIG. 2. FIG. 3A is a view for illustrating formation of a metal film. FIG. 3B is a view that shows a state of changing a relative position between the substrate and the film formation system, shown in FIG. 3A, from a contact state to a non-contact state. FIG. 3C is a view that shows a state where the substrate and the solid electrolyte membrane are relatively rotationally moved in order to change the relative position. FIG. 3D is a view for illustrating formation of a metal film in a contact state different from the contact state shown in FIG. 3A.

Initially, as shown in FIG. 3A, the substrate B is arranged on the base 21, alignment of the substrate B is adjusted with respect to the anode 11, and the temperature of the substrate B is adjusted. Subsequently, the solid electrolyte membrane 13 is arranged on the surface of the anode 11 made of the porous material, and the solid electrolyte membrane 13 is brought into contact with the substrate B.

Subsequently, the anode 11 is moved toward the substrate B by using the pressurizing means 16. Thus, the solid electrolyte membrane 13 is pressurized toward the film formation region E of the substrate B. With this, it is possible to pressurize the solid electrolyte membrane 13 via the anode 11, so it is possible to cause the solid electrolyte membrane 13 to uniformly follow the surface of the substrate B in the film formation region E. That is, while the solid electrolyte membrane 13 is brought into contact with (pressurized toward) the substrate by using the anode 11 as a backup material, it is possible to form a metal film F having a further uniform thickness.

Subsequently, voltage is applied between the anode 11 and the substrate B that serves as a cathode by using the power supply unit 14. Thus, metal is caused to precipitate onto the surface of the substrate B from the metal ions contained inside the solid electrolyte membrane 13. Because the anode 11 is in direct contact with the metallic contact pressurizing unit 19, the anode 11 is electrically continuous with the contact pressurizing unit 19. Thus, it is possible to apply voltage between the anode 11 and the substrate B by using the power supply unit 14.

At this time, the metal film F is formed while flowing the metal ion solution L inside the anode 11. As a result, by using the anode 11 made of the porous material, it is possible to penetrate the metal ion solution L through the inside of the anode 11, so it is possible to supply the metal ion solution L together with metal ions to the solid electrolyte membrane 13. Thus, during film formation, it is possible to stably supply the metal ion solution L at any time to the inside of the anode 11 made of the porous material. The supplied metal ion solution L penetrates through the inside of the anode 11 and contacts the solid electrolyte membrane 13 adjacent to the anode 11, so the metal ions are impregnated into the solid electrolyte membrane 13.

By applying voltage between the anode 11 and the substrate B that serves as a cathode, the metal ions supplied from the anode side migrate from the anode 11 side to the substrate B side inside the solid electrolyte membrane 13, and metal is caused to precipitate onto the surface of the substrate B from the metal ions contained inside the solid electrolyte membrane 13. Thus, it is possible to form the metal film F on the surface of the substrate B.

In forming the metal film F, by pressurizing the surface of the anode 11, corresponding to the film formation region in which the metal film F is formed within the surface of the substrate B, with the contact pressurizing unit 19, it is possible to uniformly pressurize the film formation region of the substrate B with the solid electrolyte membrane 13.

As a result, in forming the metal film, it is possible to pressurize, with the contact pressurizing unit 19, the surface of the anode 11 corresponding to the film formation region in which the metal film F is formed (that is, the surface of the anode, which coincides with the film formation region) within the surface of the substrate B.

Thus, it is possible to uniformly pressurize the film formation region of the substrate B with the solid electrolyte membrane 13, so it is possible to form the metal film on the substrate in a state where the solid electrolyte membrane 13 is caused to uniformly follow the film formation region of the substrate B. As a result, it is possible to form the homogeneous metal film having a uniform thickness with less variations on the surface that corresponds to the film formation region of the substrate.

When formation of the metal film F is continued in the state of FIG. 3A, the film formation region of the substrate B is uniformly pressurized by the solid electrolyte membrane 13, so hydrogen gas, that is, a by-product, is easy to accumulate in a compressed state inside the metal film F during film formation.

In the present embodiment, as shown in FIG. 3B, during formation of the metal film F, formation of the metal film F is suspended by changing the relative position between the solid electrolyte membrane 13 and the substrate B from the contact state to the non-contact state. Specifically, by driving the pressurizing means 16 upward, the relative position between the solid electrolyte membrane 13 and the substrate B is changed from the contact state to the non-contact state. Thus, it is possible to deaerate (degas) gas (gas in a pressurized state), produced as a by-product during film formation, from the formed metal film.

Subsequently, after suspension of film formation, the relative position between the solid electrolyte membrane 13 and the substrate B is changed into a contact state different from the former contact state, and film formation of the metal film is resumed in the different contact state. Specifically, as shown in FIG. 3C, the solid electrolyte membrane 13 and the substrate B are relatively rotationally moved by using the above-described rotary driving mechanisms.

After that, as shown in FIG. 3D, the solid electrolyte membrane 13 and the substrate B are brought into contact with each other by using the pressurizing means 16. As a result, different from the state of FIG. 3A, the relative position between the solid electrolyte membrane 13 and the substrate B is changed. In this state, as described with reference to FIG. 3A, a metal film is further formed on the surface of the already formed metal film F.

In this way, by changing the relative position between the solid electrolyte membrane 13 and the substrate B into a contact state different from the former contact state shown in FIG. 3A, gas, that is, a by-product, is difficult to be produced at the same portion after film formation is resumed, and, in addition, the state of contact pressure between the solid electrolyte membrane 13 and the substrate B during film formation also changes. In this way, by changing the relative position between the solid electrolyte membrane and the substrate and then resuming film formation, it is possible to suppress development of a defect, such as a pinhole.

It is possible to change the relative position between the solid electrolyte membrane 13 and the substrate B by relatively rotationally moving the solid electrolyte membrane 13 and the substrate B, and it is possible to further form a metal film on the metal film F already formed on the surface of the substrate B so as to completely coincide with the already formed metal film F.

In the present embodiment, the substrate B is pressurized by the anode 11 via the solid electrolyte membrane 13 by employing the porous material as the anode 11. Therefore, when film formation is continued in the state shown in FIG. 3A, because the anode 11 has a porous surface, there arise variations in pressure that acts on the surface of the substrate B, and a defect, such as a pinhole, is easy to develop in the metal film to be formed because of the variations.

However, in the present embodiment, as shown in FIG. 3C and FIG. 3D, because the relative position between the solid electrolyte membrane 13 and the substrate B is changed and then film formation of the metal film F is resumed, the state of variations in pressure at the interface therebetween also changes from the state, of FIG. 3A. Thus, not only the thickness of the metal film F becomes uniform, but also development of a defect, such as a pinhole, is suppressed.

The invention will be described with reference to the following examples.

Example 1

A metal film was formed by using the above-described system shown in FIG. 1. A pure aluminum substrate (50 mm×50 mm×1 mm thick) was prepared as the substrate on the surface of which a film is formed. An Ni plating film was formed on the surface of the substrate. An Au plating film was further formed on the surface of the nickel film. Subsequently, the anode of which a film formation surface corresponding to the film formation region was coated with platinum plating in 3 μm thick was used for the surface of a porous material (produced by Mitsubishi Materials Corporation) made of 10 mm×10 mm×1 mm foamed titanium.

An electrolyte membrane (Nafion N117 produced by DuPont) having a thickness of 173 μm was used as the solid electrolyte membrane. 1 mol/L copper sulfate solution was prepared as the metal ion solution, and film formation was carried out at a current density of 10 mA/cm2, a flow rate of the metal ion solution of 10 ml/min while the anode was pressurized from above by 0.5 MPa. At this time, after film formation for ten seconds (precipitation time before rotation) under the condition shown in FIG. 1, formation of the metal film was suspended by changing the relative position between the solid electrolyte membrane and the substrate from a contact state to a non-contact state. Subsequently, the relative position between the solid electrolyte membrane and the substrate was changed into a contact state different from the above-described contact state (the solid electrolyte membrane and the substrate were brought into contact with each other while rotating the solid electrolyte membrane side by 180°), and formation of the metal film was resumed in the different contact state. A film formation time after rotation (precipitation time after rotation) was set to nine minutes 50 seconds.

Example 2 to Example 4

The metal film was formed as in the case of Example 1. Example 2 to Example 0.4 differ from Example 1 in that the precipitation time before rotation and the precipitation time after rotation were set as shown in Table 1.

Comparative Example 1

The metal film was formed as in the case of Example 1. Comparative Example 1 differs from Example 1 in that the precipitation time before rotation and the precipitation time after rotation were set as shown in Table 1.

The coverage of each of the metal films formed in Example 1 to Example 4 and Comparative Example 1 and whether there is a pinhole in each individual metal film were checked. The results are shown in Table 1.

TABLE 1

| | Precipitation Time before Rotation | Precipitation Time after Rotation | Coverage | Pinhole |
|---|---|---|---|---|
| Example 1 | 10 Seconds | 9 Minutes 50 Seconds | 100% | Excellent |
| Example 2 | 2 Minutes | 8 Minutes | 100% | Excellent |
| Example 3 | 5 Minutes | 5 Minutes | 100% | Excellent |
| Example 4 | 7 Minutes | 3 Minutes | 98% | Good |
| Comparative Example 1 | 0 Minutes | 10 Minutes | 97% | Poor |

In the case of Example 1 to Example 3, the coverage of each metal film is 100%, and almost no pinhole was found. In the case of Example 4, the coverage was slightly lower than those of Example 1 to Example 3, and the number of pinholes was slightly larger than those of Example 1 to Example 3. The metal film of Comparative Example 1 had a myriad of pinholes. This is presumably because, in the case of Example 1 to Example 4, gas that is produced in the metal film was deaerated in process of film formation and the film was formed while bringing the solid electrolyte membrane into contact with the substrate in different contact states.

It is presumable that, when the relative position between the solid electrolyte membrane and the substrate is changed until a half of the total film formation time (precipitation time), that is, before the thickness of the metal film reaches a half of a target thickness, it is possible to form a metal film having a high coverage and a small number of pinholes.

The embodiment of the invention is described in detail above; however, the invention is not limited to the above-described embodiment. The invention may be variously changed in design without departing from the spirit of the invention recited in the appended claims.

For example, in the present embodiment, the film formation region has a circular shape. When the film formation region has a square shape, the solid electrolyte membrane and the substrate just need to be rotated by 90° around a rotation axis set to the center of the square film formation region. When the film formation region has a rectangular shape, the solid electrolyte membrane and the substrate just need to be rotated by 180° around a rotation axis set to the center of the rectangular film formation region. When the film formation region has a non-symmetrical shape, film formation just needs to be carried out by sequentially using a plurality of the film formation systems having the same configuration.

The invention claimed is:

1. A film formation method for forming a metal film, the film formation method comprising:

arranging a solid electrolyte membrane on a surface of an anode between the anode and a substrate, the substrate serving as a cathode;

bringing the solid electrolyte membrane into contact with the substrate;

forming a metal film on a surface of the substrate by causing metal to precipitate onto the surface of the substrate from metal ions through application of voltage between the anode and the substrate in a first contact state where the solid electrolyte membrane contacts the substrate, the metal ions being contained inside the solid electrolyte membrane, the metal film being made of the metal;

during formation of the metal film, suspending formation of the metal film by changing a relative position between the solid electrolyte membrane and the substrate from the first contact state to a non-contact state where the solid electrolyte membrane does not contact the substrate;

after suspension of the formation, changing the relative position between the solid electrolyte membrane and the substrate into a second contact state different from the first contact state; and resuming formation of the metal film in the second contact state, wherein a porous material is used as the anode, and the porous material allows a solution containing the metal ions to penetrate through the porous material and supplies the metal ions to the solid electrolyte membrane.

2. The film formation method according to claim 1, wherein, at the time of resuming formation of the metal film, the relative position between the solid electrolyte membrane and the substrate is changed by relatively rotationally moving the solid electrolyte membrane and the substrate.

3. The film formation method according to claim 1, further comprising:

in forming the metal film, uniformly pressurizing a film formation region of the substrate with the solid electrolyte membrane by pressurizing a surface of the anode, the surface of the anode corresponding to the film formation region in which the metal film is formed within the surface of the substrate.

4. A film formation system for forming a metal film, the film formation system comprising:

an anode;

a solid electrolyte membrane arranged on a surface of the anode between the anode and a substrate, the substrate serving as a cathode;

a power supply unit configured to apply voltage between the anode and the substrate, the film formation system being configured to form a metal film on a surface of the substrate by causing metal to precipitate onto the surface of the substrate from metal ions through application of voltage between the anode and the substrate in a first contact state where the solid electrolyte membrane contacts the substrate, the metal ions being contained inside the solid electrolyte membrane, the metal film being made of the metal; and a change mechanism configured to change a relative position between the solid electrolyte membrane and the substrate from the first contact state to a non-contact state where the solid electrolyte membrane does not contact the substrate and then change the relative position into a second contact state different from the first contact state, wherein the anode is made of a porous material, and the porous material allows a solution containing the metal ions to penetrate through the porous material and supplies the metal ions to the solid electrolyte membrane.

5. The film formation system according to claim 4, wherein the change mechanism is configured to change the relative position between the solid electrolyte membrane and the substrate by relatively rotationally moving the solid electrolyte membrane and the substrate.

6. The film formation system according to claim 4, further comprising:

a contact pressurizing unit configured to contact the anode and pressurize the surface of the substrate with the solid electrolyte membrane via the anode, the contact pressurizing unit being configured to pressurize a surface of the anode so as to uniformly pressurize a film formation region, the surface of the anode corresponding to the film formation region in which the metal film is formed within the surface of the substrate.

* * * * *